United States Patent [19]

Spitler et al.

[11] Patent Number: 4,703,767

[45] Date of Patent: Nov. 3, 1987

[54] METHOD AND APPARATUS FOR PNEUMATIC-TOOL MAINTENANCE

[76] Inventors: Jack H. Spitler, 196 Yale La., Seal Beach, Calif. 90740; Elden L. Goodenow, 686 South Arroyo Pkwy., Apt. 121, Pasadena, Calif. 91105; Lawrence E. Jones, 5359 Middleton Rd., San Diego, Calif. 92109

[21] Appl. No.: 767,430

[22] Filed: Aug. 20, 1985

[51] Int. Cl.[4] ..... B08B 3/00

[52] U.S. Cl. ..... 134/102; 134/166 R

[58] Field of Search ..... 173/60, 61, 74; 15/320, 15/323, 104.01; 134/100, 102, 116; 136/166

[56] References Cited

U.S. PATENT DOCUMENTS 3,601,135 8/1971 Marlow ..... 134/102

4,059,123 11/1977 Bartos et al. ..... 134/102

*Primary Examiner*—E. R. Kazenske

*Assistant Examiner*—Willmon Fridie, Jr.

*Attorney, Agent, or Firm*—Bruce L. Birchard

[57] ABSTRACT

The method and apparatus for maintaining pneumatic tools comprises applying, in an automatically timed sequence, to the tool to be maintained, compressed air mixed with diesel oil; flushing air and compressed air mixed with lubricating oil; the tool being secured during maintenance by the combination of a pneumatically operated clamp and a slope-walled lower-end cup and being totally enclosed to prevent escape of maintaining oil-mist to the atmosphere.

3 Claims, 11 Drawing Figures

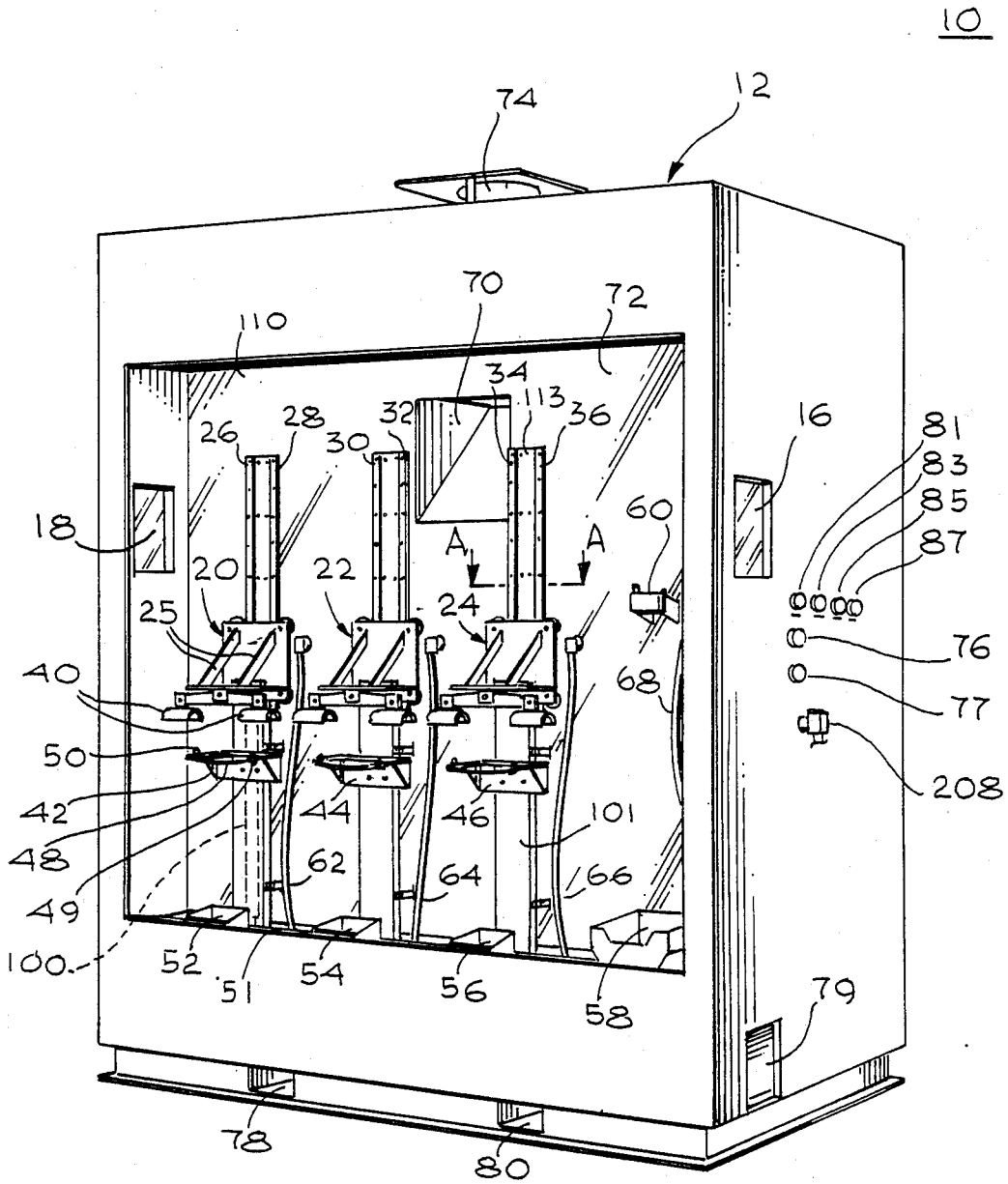
Fig. 1
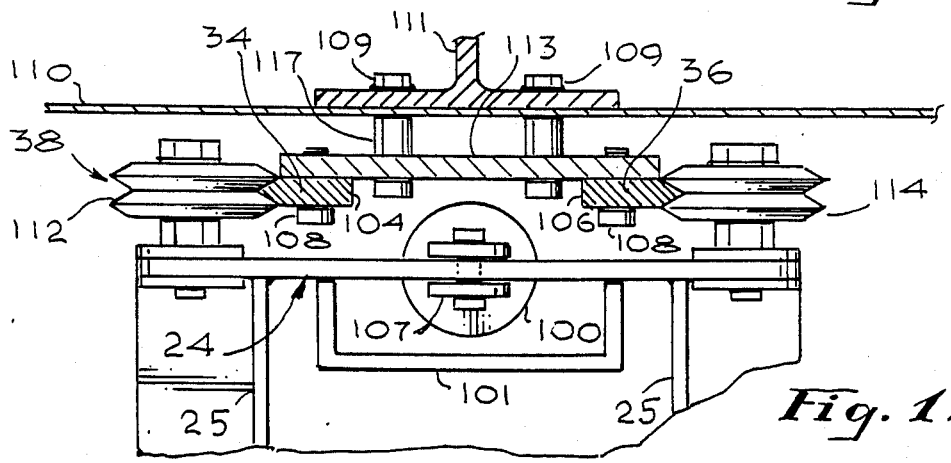
Fig. 1A-A

METHOD AND APPARATUS FOR PNEUMATIC-TOOL MAINTENANCE

BACKGROUND OF THE INVENTION

1. Field of the Invention

This invention relates to equipment for maintaining pneumatic tools and, more specifically, to to a pneumatic method and pneumatic equipment for effecting cleaning and lubrication of such tools.

2. Prior Art

In the construction, street maintenance and utility maintenance fields, pneumatic-tools have found widespread use. They are used for breaking pavement, drilling rocks, digging trenches and tamping soil prior to the laying of concrete on the surface of that soil. An example of a utility that finds widespread use for pneumatic-tools is Southern California Gas Company located in Los Angeles. However, its use of pneumatic-tools is not unique and utilities throughout the country utilize such tools to reduce labor costs in the maintenance of the utilities, particularly subterranian-located facilities of such utilities. In the course of use such pneumatic-tools collect sludge, grime and dirt from the sites in which they are used. As a result of such accumulations, the efficiency of operation of such tools is reduced and, in some cases, the operation may be totally stopped. In the past, equipment has been available which permitted, in a rudimentary and dangerous way, the flushing of each tool with No. 2 diesel oil to remove the sludge and other matters that tend to collect in the pneumatic-tools. Such equipment suffered from a number of serious deficiencies. For example, it was difficult to load the pneumatic-tool to be cleaned into the cleaning cabinet. Further, only one tool could be cleaned at a time and the controls were difficult to operate. In addition, the operator or operators of the prior art cleaning equipment were exposed to mists and vapors of the solvent utilized in the tool cleaner and concerns over these hazardous conditions have been expressed by employers and employees alike. Further, lubrication of the tools following cleaning was necessary but not automatic.

Therefore, it is an object of this invention to overcome the general problems and disadvantages of the prior art devices.

It is a further object of this invention to provide a pneumatic-tool cleaner which operates solely off pneumatic power, it is completely automatic in its operation, will accommodate multiple pneumatic-tools and multiple types of pneumatic-tools, will not expose the operator or operators to any fumes during or after the cleaning process and will lubricate each tool after it has been cleaned.

SUMMARY OF THE INVENTION

A selectively closeable cabinet includes a plurality of tool positions, one for each type of tool to be cleaned, i.e. pavement breakers, rock drills, trench diggers and tampers. Each tool is pneumatically clamped in place in its respective holder and, its input is coupled to a controlled source of, alternatively, a mixture of No. 2 Diesel fuel or a lubricant, such as pneumatic-tool oil. The application of each of the mixtures is determined by the pneumatic logic circuit of the equipment.

The Diesel Oil used for cleaning is discharged into a collector pan after appropriate filtering and can thus be disposed of or re-claimed. When the cleaning cycle is completed, the lubricating cycle begins, automatically, and continues for a time determined by the pneumatic logic. Waste lubricant is also collected for treatment and disposal. During these processes of cleaning and lubricating the equipment is enclosed and all mist created by the pneumatic operation of the tool during cleaning and lubricating is exhausted from within the equipment by a mist collector.

The region of the equipment wherein the cleaning and lubricating take place is closed off by an interlocked door which, if opened, causes the pneumatic flow to the tool or tools to be terminated until the equipment is, once again, closed, whereby escape of the hazardous mist to the operator's environment is prevented. The equipment is designed for easy loading of the tools to be cleaned and for easy transport of the equipment to the sites of the work on which the pneumatic-tools are being used. Operating air under pressure, can be obtained from an electrically or gas-engine driven compressor carried by the truck used to transport the cleaning equipment, or the truck engine, itself, may drive the compressor.

Significant cost savings may be realized by the use of this invention. Using the four-station tool cleaner described herein, one person should be able to clean four tools in 20 minutes, for an average of five man-minutes per tool, per cleaning. For 50,000 tool cleanings per year (which is a reasonable number of tool cleanings for about 2,000 pneumatic-tools) and at $18.00 per hour for labor, this time saving results in an annual cost savings for the company utilizing this equipment of about $75,000. In addition, the ever present requirements of OSHA will be easily met and operator morale will be improved.

BRIEF DESCRIPTION OF THE DRAWINGS

This invention can best be understood by reviewing the description which follows in conjunction with the drawings herein, in which:

FIG. 1 is a front-perspective view of the pneumatic-tool cleaning and lubricating equipment, according to this invention, without the tools to be cleaned being in place;

FIG. 1A—A is a sectional view taken along line A—A in FIG. 1;

DETAILED DESCRIPTION OF THE PREFERRED EMBODIMENT

Figure 2:
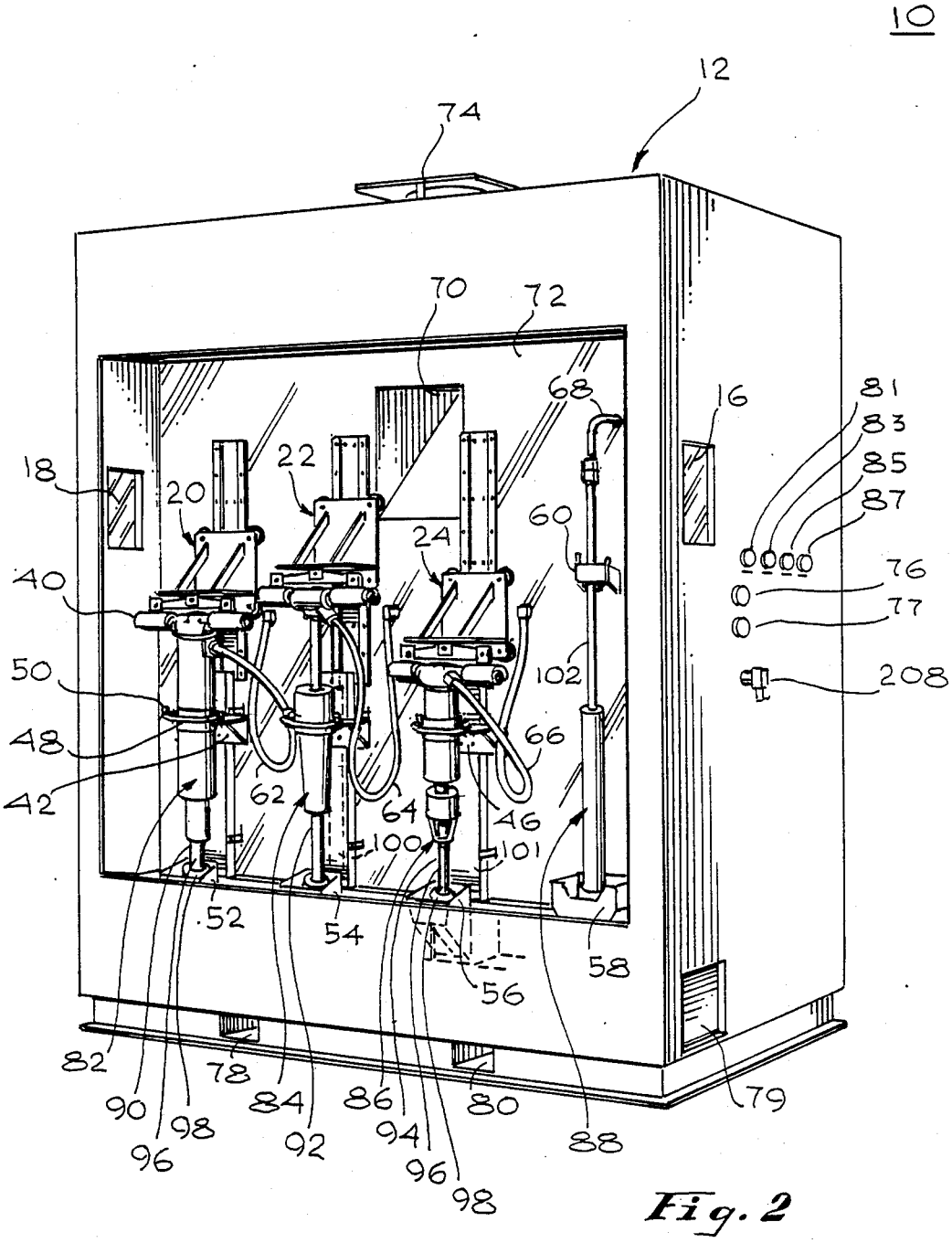
FIG. 2 is a front-perspective view of the apparatus of FIG. 1 with the tools to be cleaned in place.

In FIGS. 1 and 1A, pneumatic-tool cleaner 10 has a cabinet 12 in which there is a pair of viewing windows 16, 18 to permit the operator to view the cleaning and lubricating process while it is under way, without exposing the operator to the hazards of inhaling the mist that is generated in the course of the cleaning and lubricating processes. Tool clamp assemblies 20, 22 and 24 are movably supported on tracks 26, 28; 30, 32, and 34, 36, respectively. Each of the tool clamp assemblies has four wheels, 38, which engage their respective tracks to provide for smooth vertical motion of tool clamp assemblies 20, 22 and 24. Each of the tool clamp assemblies also has bracket portions 40 which engage, and firmly hold, the handles of tools being cleaned. Reinforcing diagonals 25 support the bracket portions 40.

Safety brackets 42, 44 and 46 are supported from cabinet 12 below tool clamp assemblies 20, 22 and 24, respectively and have associated with each of them safety gates 48, which are pivotally supported at one end from bracket 42, 44, or 46, respectively, on pivot 49 (see FIG. 3) and, at the other end are held in a closed position by pin 50, which is adapted to be received by an opening in its associated safety bracket to encompass the tool being cleaned or lubricated so as to prevent its escaping from its position within its respective tool clamping assembly during operation of the tool. Such operation, of course, produces a large level of vibration. Were it not for the safety brackets and the associated safety gates, the tools would, upon disengagement from the clamping tool clamp assemblies during cleaning, inflict disastrous results.

Figure 5A:
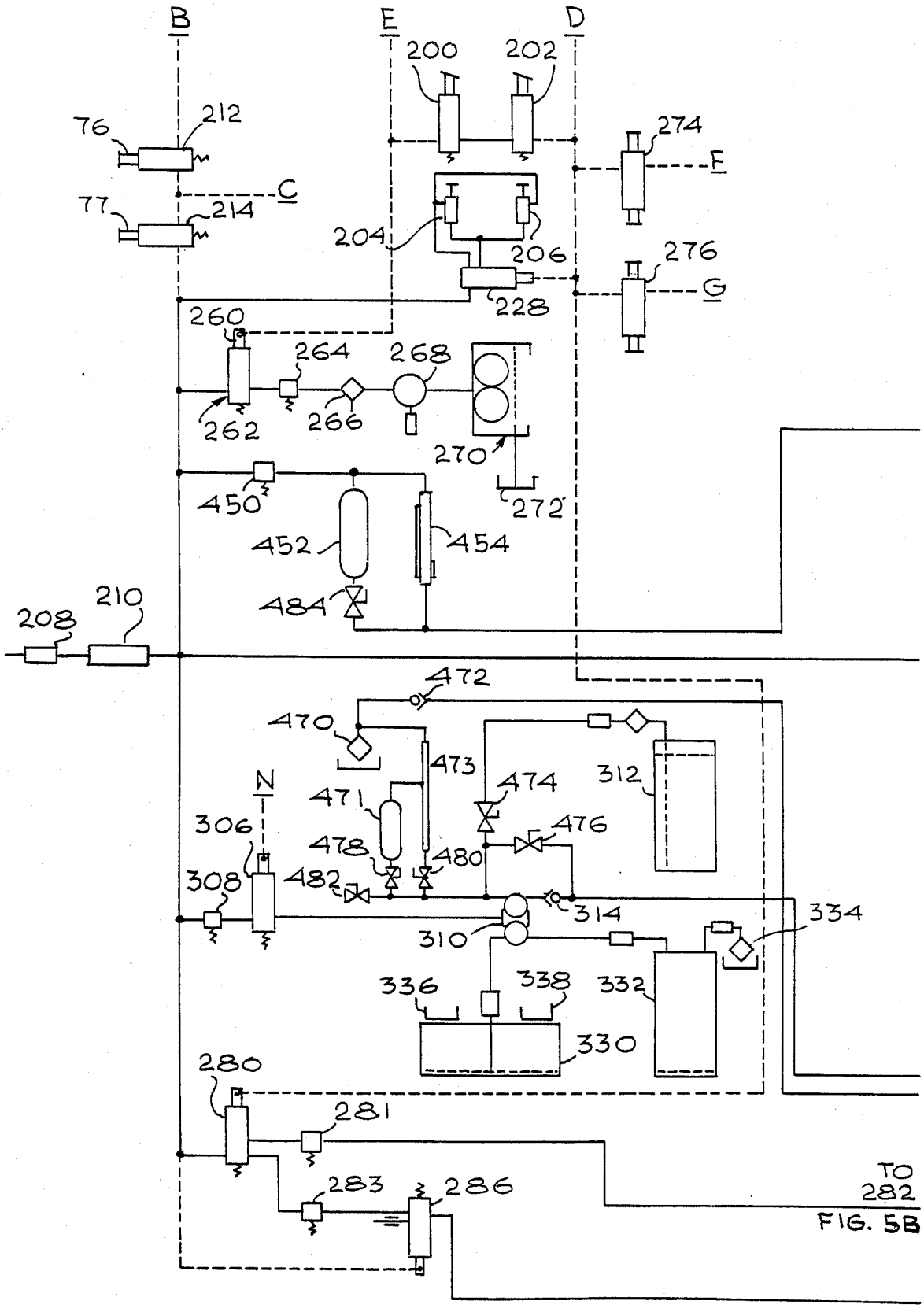
FIGS. 5A and 5B, together, constitute a schematic-pneumatic diagram of the equipment according to this invention; and, FIGS. 6A and 6B, together, constitute is a schematic diagram of the pneumatic logic circuit for use in the present invention.

Centrally located with respect to each of the tool clamp assemblies and located in the upper floor 51 of cabinet 12 (See FIG. 3B) is a plurality of tool-receiving cups 52, 54 and 56. These cups are designed to receive, for example, a pavement breaker, a rock drill and a trench digger, respectively. These tools appear in FIG. 2. The final cup 58 is designed to receive a tamper tool which is utilized in tamping sand or dirt after digging and before a surface covering, such as concrete, is applied. Each of these cups 52, 54, 56 and 58 has a drain in its lower region to permit fluid discharged from the tool to drain to a collector tank shown, schematically, at 330 in FIG. 5A.

Directly above cup 58 is tamperguide-assembly 60 which, in use, encompasses the upper shaft on the tamper to permit its vertical travel but to prevent its escape laterally during the cleaning process. Hoses 62, 64, 66 and 68 are provided to feed the cleaning and pneumatic lubricating fluids from their sources, not shown into the pneumatic-tool held in the respective, adjacent tool clamp assemblies 20, 22, 24 and into the tamper tool held by guide 60. Exhaust 70 is provded in partition 72 of cabinet 12 to permit extraction of mist from the tool cleaning region into a commercially available mist collector, 270, shown schematically in FIG. 5A, Vent 74 is provided for venting the air from cabinet 10 after the mist is removed from that air.

Appropriate "on-off" controls 76, 77 are provided to permit operation of pneumatic-tool cleaner 10. Additionally, selector buttons 81, 83, 85, 87 are provided to select which tool or tools are to be cleaned and lubricated, Trap door 79 is provided to cover waste collection trays 330, shown schematically in FIG. 5A. To permit easy handling of tool cleaner 10, fork-lift openings 78 and 80 are provided.

Figure 3A:
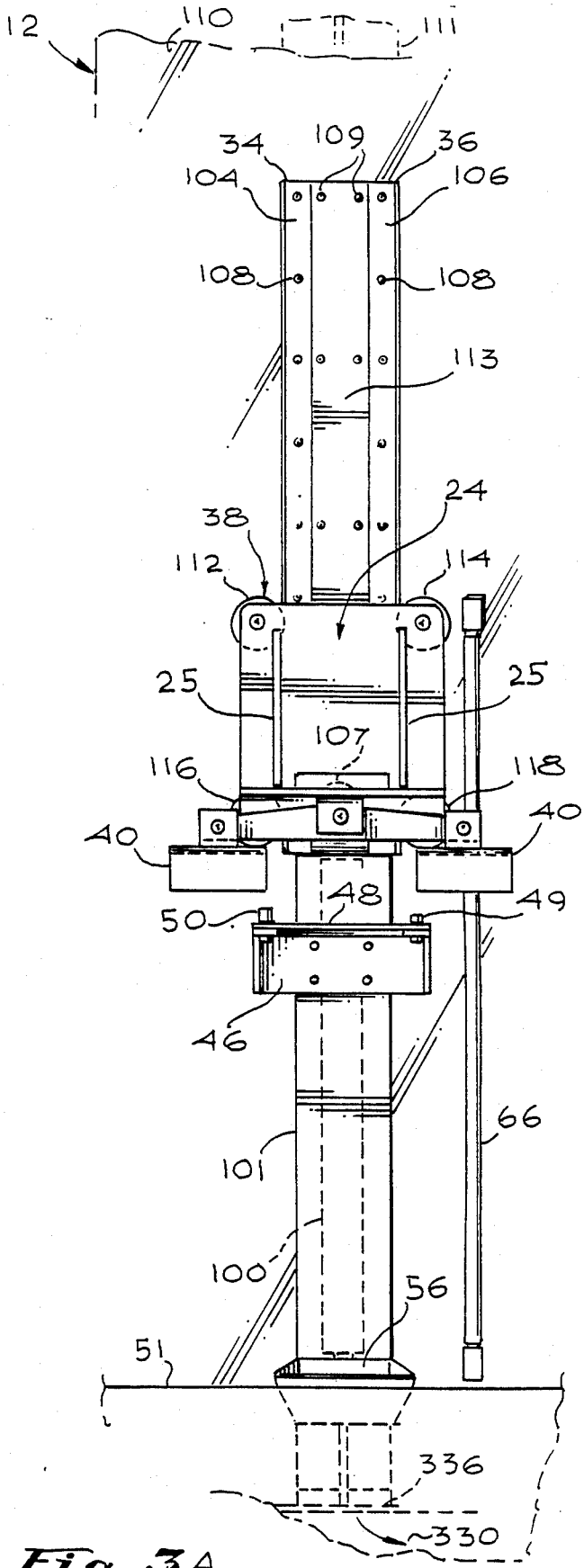
FIG. 3A is an elevational view of a portion of the equipment of FIGS. 1 and FIG. 2.
Figure 3B:
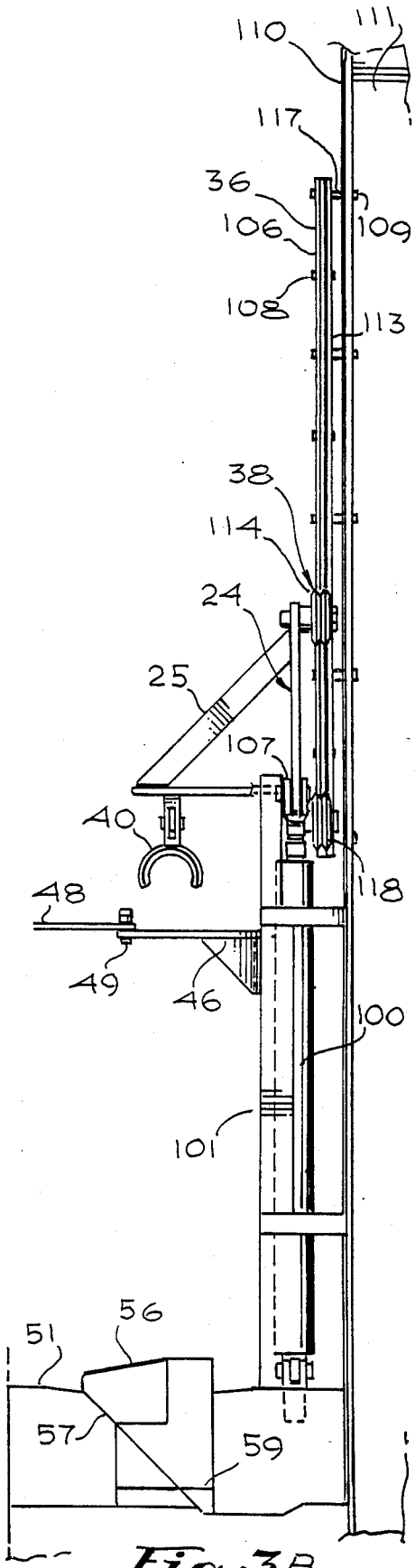
FIG. 3B is a side view of the structure shown in FIG. 3A.

In FIG. 1A-A, which it may be helpful to review in conjunction with FIG. 3B, it can be seen that tool clamp assembly 24 is movably supported from tracks 34, 36 by wheels 112, 114. Vertical motion of assembly 24 is produced by pneumatic piston 100 which is coupled through linkage 107 to assembly 24. Cylinder 100 and its linkage 107 to assembly 24 are surrounded by guard 101. Tracks 104 and 106 are supported by screws 108 on vertical member 111 which is coupled thru screws 109 to partition 110.

Turning to FIG. 2, four typical pneumatic-tools are shown in position for cleaning and lubricating. Tool 82 is a pavement breaker, tool 86 is a rock drill, tool 84 is a trench digger and tool 88 is a tamper. Tool clamp assemblies 20, 22 and 24 are shown in a position with their bracket portions 40 engaging the handles of the respective tools. Safety gate 48 is shown encompassing tool 82 with pin 50 in an appropriate opening in bracket 42. The safety gate systems of the other two tools are shown in position, as well. With each of the tools, excluding the tamper 88, the actual cutting bit has been removed and each of these operating elements of the respective pneumatic-tools has been replaced by an element called a "gad". Thus tool 82 has a gad 90, tool 84 has a gad 92 and tool 86 has a gad 94. Each gad has a shaft portion 96 and a cylindrical end portion 98 which rests in its respective cup. The gad, of course, prevents destruction of each of the cups in the cleaning and lubricating process. Tamper 88 has a flat end, inherently, which prevents destruction of cup 58 by the intense vibrations that occur when the cleaning and lubricating processes take place. Guide 60 is shown encompassing shaft 102 of tamper 88. As can be indicated, shaft 102 can travel vertically during the tool-cleaning process. The hoses carrying cleaning or lubricating fluids and compressed air are shown connected to their respective tools, in FIG. 2.

Figure 2A:
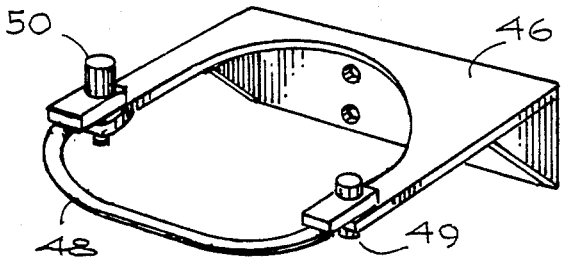
FIG. 2A is an enlarged view of a portion of the structure of FIG. 2.

In FIGS. 2A, safety bracket 46 has a safety gate portion 48 which is supported pivotably on pivot 49 and is held in a closed position (when a tool is in place) by pin 50.

An important part of the equipment of this invention is the apparatus for clamping the pneumatic-tools in place during cleaning and for guiding the shaft of the tamper, also during cleaning. One of the tool clamp assemblies and associated mechanical elements is shown in FIGS. 3A and 3B. The remaining tool clamp assemblies and their associated mechanical elements are substantially identical with the one shown in FIG. 3A and need not be described further. In FIG. 3A, tracks 104 and 106 are secured, by means of screws 108, to a vertical support member 113 which, in turn, is coupled to partition 110 thru screws 109 and spacers 117. Tracks 104 and 106 are oriented parallel to each other and vertically. Tool clamp assembly 24 is movably supported on tracks 104 and 106 by means of wheels 112, 114, 116 and 118. Movement of brackets 40 of tool clamp assembly 24 into and out of contact with the handle a tool to be cleaned is effected or aided by a pneumatically driven cylinder and piston 100, schematically in FIG. 3B.

Safety bracket 46 is shown secured to guard 101. Hose 66 is shown in position ready to be hooked to a tool to be cleaned.

In FIG. 3B, cup 56 has ramp 57 which guides the gad on the tool to be cleaned to its final position on bottom 59. The sloped nature of ramp 57 makes easy the insertion and removal of a tool, despite the weight of the tool. Button 59 has an opening therein which permits oil to pass into waste collector tank 330 by way of filter tray 336.

Figure 4:
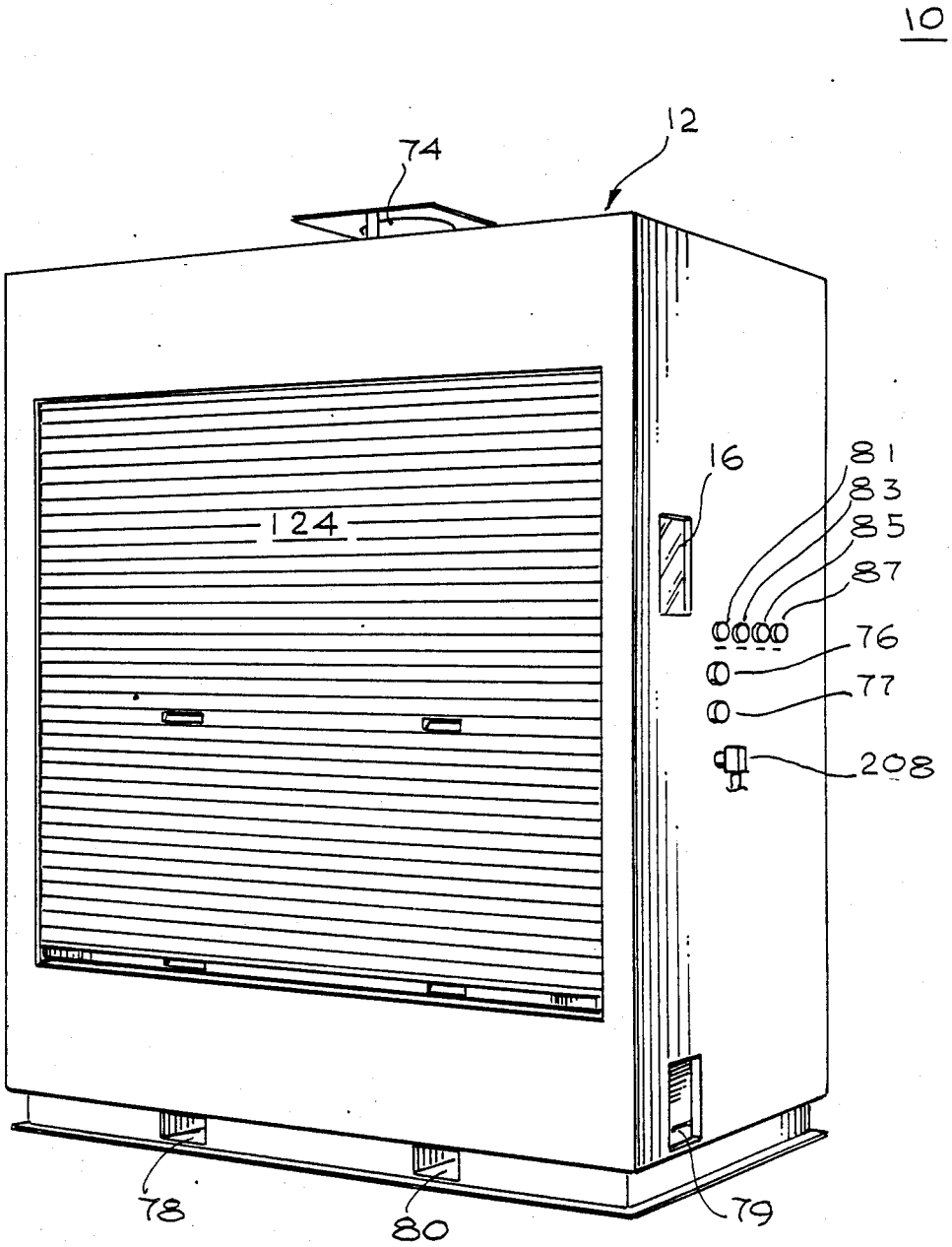
FIG. 4 is a front-perspective view of the equipment of FIG. 1 with the forward articulated door in a closed position.

As has been indicated, one of the advantages of the equipment according to this invention is that any mist formed by cleaning or lubricating processes is totally confined within the unit and does not escape to enter into the lungs of the operators. In FIG. 4, the method for sealing the front of the cabinet 12 is shown. In FIG. 4, rolling shutter door 124 can be raised or lowered to open or close the cleaning-lubricating section of the cabinet 12. When it is closed, as shown in FIG. 4, it completely confines the cleaning-lubricating region so that the mist created during the cleaning-lubricating operations can be controlled and exhausted, after appropriate collection, through appropriate filters to the atmosphere through vent 74. Shutter door 124 has left and right interlocks 200, 202, respectively to prevent any operation of the tools being cleaned unless door 124 is closed in prevent the escape of mist from the cleaning-lubricating region of the cabinet 12. These interlocks may be straight leaf-limiter valves such as model MV-70 available from Mead.

Figure 5B:
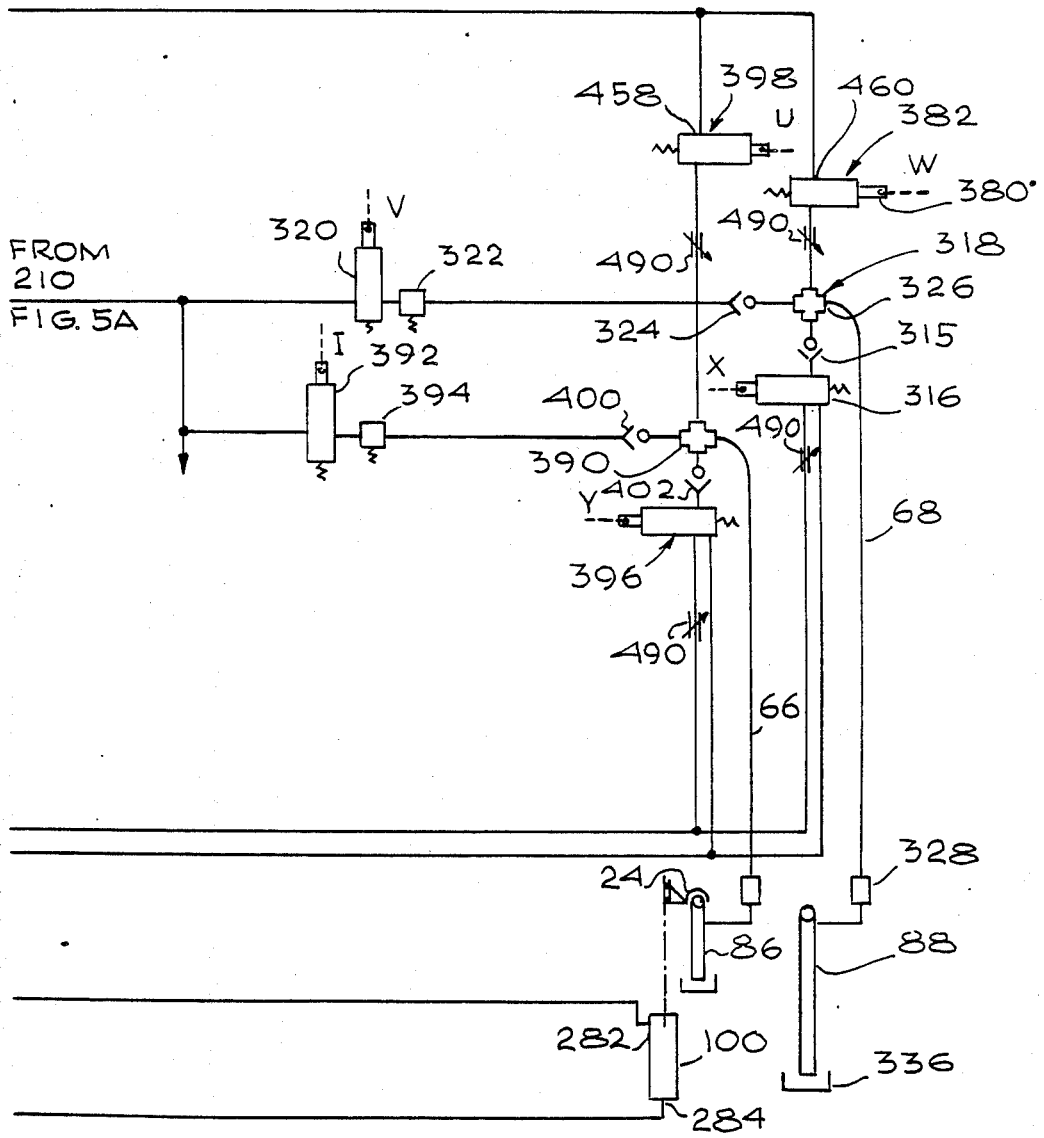
Figure 6A:
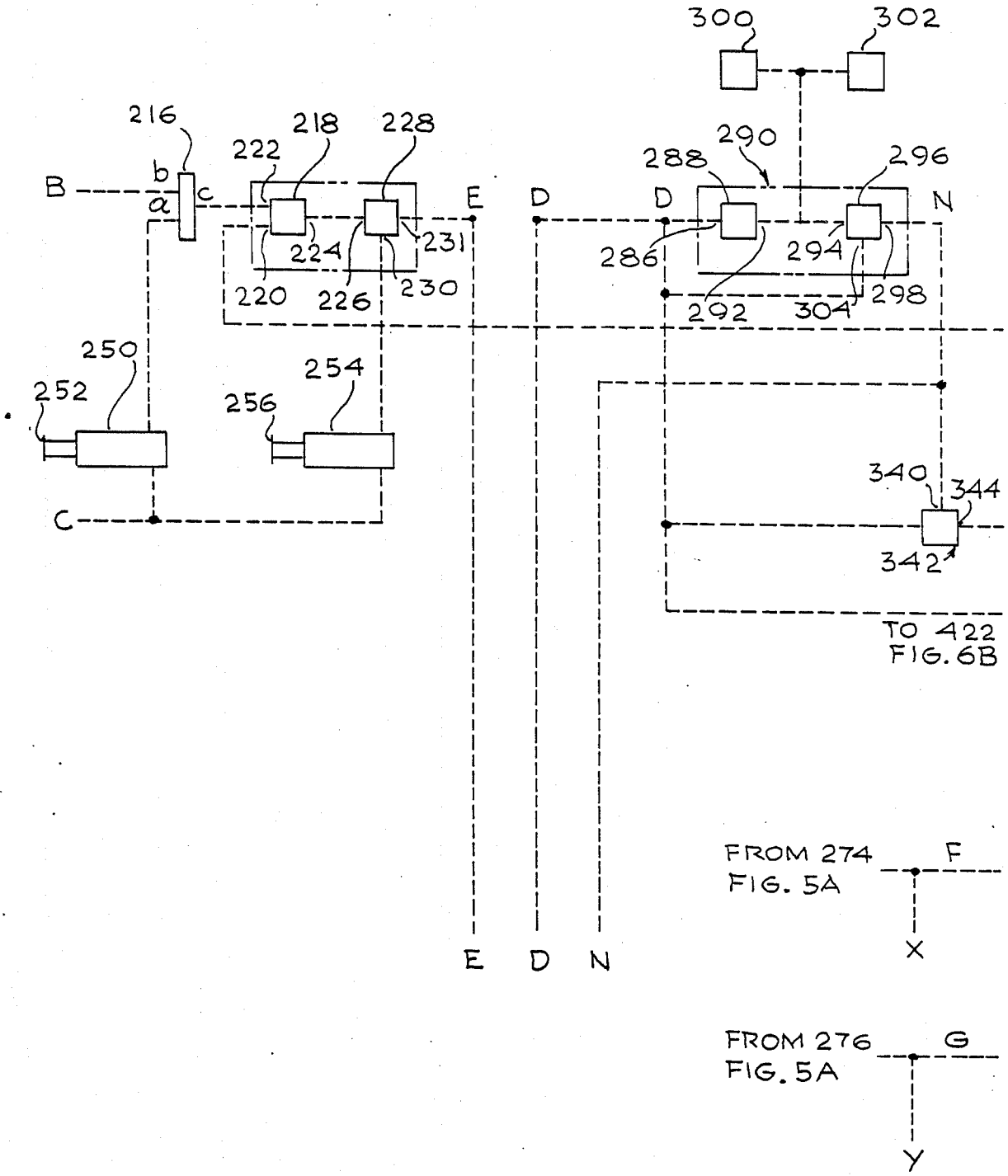
Figure 6B:
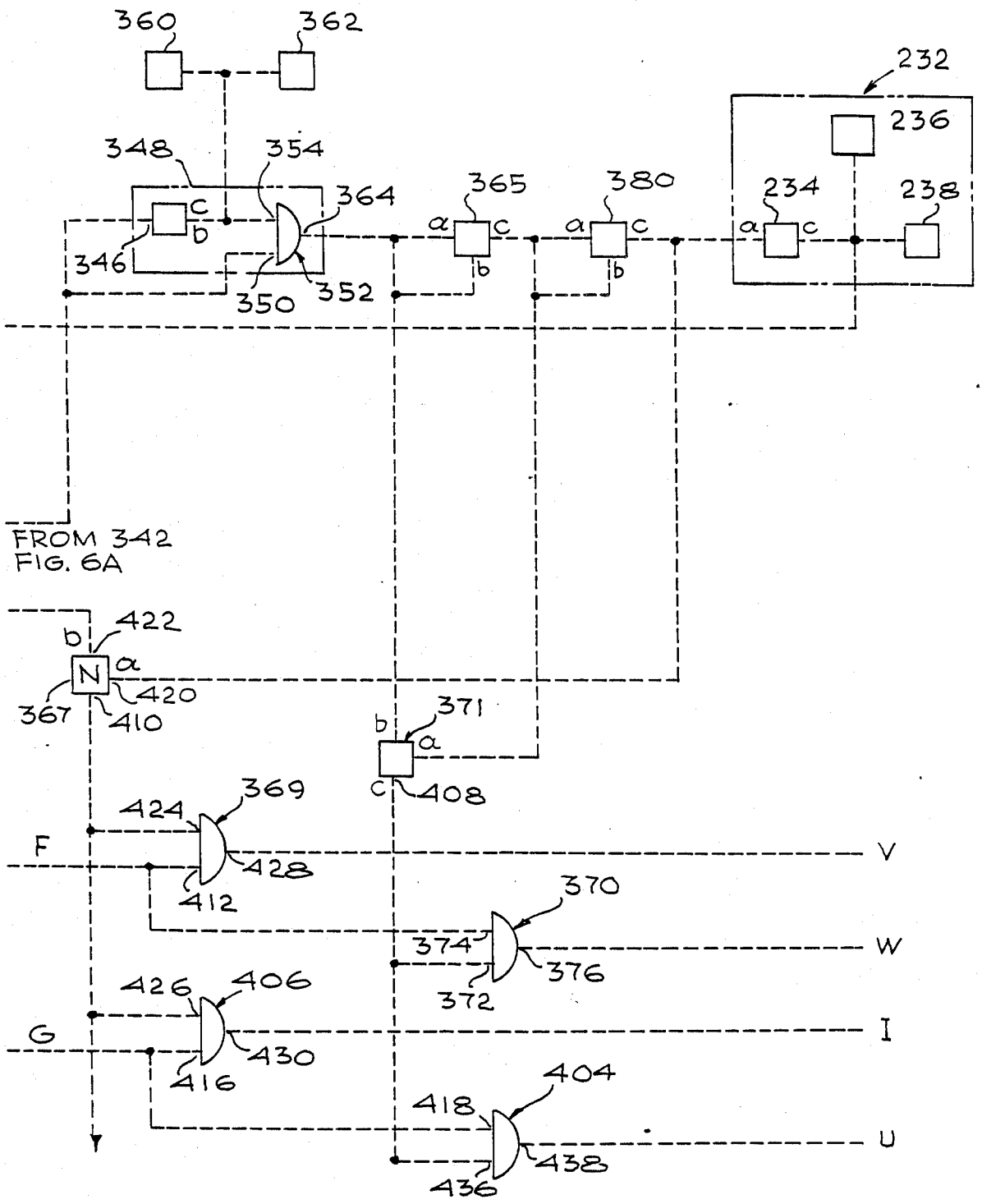

The interrelationship of the various parts of this invention and how they work together to provide the cleaning and lubricating of the pneumatic-tools, as taught by this invention, can best be understood by referring to FIGS. 5 and 6 wherein there is presented a schematic diagram of the total pneumatic circuit contained in cabinet 12. The locking of the left and right sides of door 124 is accomplished by means of air cylinder locks 204, 206. Such air cylinders are available from Bimba as Model FOS-040.5.

To operate the system compressed air at, for example, 90 pounds per square inch with a flow rate of 90 cubic feet per minute is applied to input connector 208, which may be a quick-disconnect type of connector. The air then passes to pressure regulator 210, which may include an air filter. The output of the air filter 210 is applied to a manifold which distributes the air, under pressure, to the various elements in the pneumatic circuit. Normally-off valve 212 which is actuated by "Start" button 76 receives its air supply by way of normally-on valve 214 which may be actuated by "Stop" button 77. In the system according to this invention valve 212 is the "Start" valve and valve 214 is the "Stop" valve. The results of pushing start button 76 can be seen more clearly in FIG. 6. When button 76 is pushed, valve 212 is turned on and air pressure is applied to port "b" of pneumatic logic element 216 which is a pneumatic "or" gate. Gate 216 combines to air signals so that either can produce pressure at the output port "c". In this system the second air signal is deriveable from valve 250 upon actuation of maintenance "Start" pushbutton 252 which pneumatically parallels operator "Start" valve 212. Similarly there is a maintenance "Stop" valve 254 operable by maintenance "Stop" button 256, in parallel pneumatically with operator's "Stop" valve 214. Because of mechanical lock-out arrangements, an operator's actuation of either the "Start" or "Stop" buttons 76, 77 cannot be overridden by actuation of maintenance "Start" or "Stop" buttons, and vice versa. The pressurized output from element 216 is fed to a second pneumatic logic element 218 having two input ports 220 and 222 and an output port 224 which is coupled, pneumatically to input port 226 of pneumatic memory element 228 which has applied to port 230, thereof, pressurized air from normally-on maintenance "Stop" valve 254. Memory element 228 has an output port 231. Element 218 is a "Set-Reset" pneumatic logic element. The elements 218 and 228 work together to perform a memory function. With a constant air supply at port 230 of memory element 228 and with output port 224 of Set-Reset element 218 connected to port 226 of memory element 228, a momentary pressure signal at port 222 of Set-Reset element 218 will cause output port 231 of memory element 228 to become pressurized and that port will remain pressurized until a pneumatic signal is received at port 220 of Set-Reset element 218. The memory function of this combination is pneumatically retained. If the air supply is removed, for example if the Stop valve 214 is pushed so as to break the flow of air to port 230 of memory element 228, the output at port 231 of memory element 228 will cease and will remain off when air is restored to port 230, as, for example, when button 77 is released after having been pressed to stop the equipment from operating, until a new set signal is applied to input port 222 of Set-Reset element 218. In an automatic cycle the reset signal to port 220 produces snap action in Set-Reset element 218 and is received by way of timing circuit 232 so as to achieve a delayed reset function. As can be seen, timing circuit 232 includes dial adjustable timer 234 in addition to accumulators 236 and 238.

The air signal appearing at output port 231 of memory element 228 is applied to air line E and appears at pilot element 260 of valve 262, which is normally off, causing valve 262 to turn "on" and air pressure to be applied thru pressure regulator 264 and lubricator 266 to air motor 268 which drives mist collector 270. Mist collector 270 is commercially available from Global Purification Co., Inc. and need not be described in detail here. It draws in oil mist from the cleaning-lubricating region of cabinet 12 and causes it to collect and be deposited in sump 272. The mist-free air is exhausted thru vent 74. Thus, mist collector 270 operates continuously while either "Start" valve is "on".

Air line E is also coupled thru normally "off" interlock valves 200, 202 to air line D, a manifold to which various valves, including selector valves 274, 276, are pneumatically coupled. If the interlocks are moved to the "on" condition by closing the rolling shutter front door 124 on cabinet 12, air pressure appears in line D and is applied to the pilot in four-way pilot valve 278 to open that valve and actuate door locks 204, 206. Simultaneously, pressure on line D is applied to four-way pilot valve 280, causing it to apply air pressure to port 282 of cylinder 100 (by way of pressure regulator 281) with a resulting downward motion of clamp 24 until it engages handle 284 of tool 86 securely. In the absence of the air signal on line D, air pressure is applied to port 284 of cylinder 100 by way of pressure regulator 283 and pilot valve 286 and counterbalances the weight of clamp 24, permitting easy raising and lowering of clamp 24 by an operator.

The air signal on line D is also applied to input port 286 of dial-adjustable timing element 288 in cleaning-fluid-timer 290. The air signal at output port 292 of element 288 is coupled to port 294 of "NOT"-gate 296, the output signal from port 298, of which, appears on air line N. Accumulators 300, 302 are also coupled to port 294. Air line D is also coupled to port 304 of "NOT"-gate 296.

As has been indicated, timer 290 controls the time cleaning fluid is applied to the tool being cleaned. Thus, the air signal on line N is applied to pilot valve 306, which is normally "off", causing it to turn "on" applying air from pressure regulator 308 to diaphragm pump 310 which is a dual function pump. In the first case it pumps No. 2 Diesel fuel from tank 312 thru check valves 314 and 315 and pilot valve 316 to mixer 318. Simultaneously, air from the main source 208, is fed thru pilot valve 320, pressure regulator 322 and check valve 324 to mixer 318, the output from which, at port 326 is a mixture of air and Diesel fuel which passes thru hose 68 and connector 328 to the tamper tool 88.

Simultaneously, diaphragm pump 310 is pumping waste oil from waste collector tank 330 into waste-oil holding tank 332, which has a filtered vent 334. Waste oil passes into collector tank 330 by way of trays and filters 336, 338.

The length of time the cleaning step continues is determined by the elements in timer 290.

The N line from timer 290 is also coupled to port 340 of "NOT"-gate 342 the output port 344 of which is coupled to the input port 346 of purging timer 348 and to port 350 of "AND"-gate 352 in the purging timer 348. The purpose of purging timer 348 is to control the length of time purging air is applied to a tool after the cleaning step and before the lubicating step. Purging timer 348 includes dial adjustable timer 354 the output port of which is pneumatically coupled to one port 354 of "AND"-gate 352, to which accumulators 356, 358 are also coupled to extend the length of the timing cycle in purging timer 348. The duration of the cleaning step and of the purging step may be 25 seconds. When the dial adjustable timer 346 shuts off, no air is applied from port 346 and as soon as the air in accumulators 360, 362 dissipates, "AND"-gate 352 has no air signal at its output port 364 and the purging cycle ends.

With a delay determined by adjustable delay element 366 and "NOT"-gate 368 a control signal is applied to "AND"-gate 370 at port 372 and a second signal from selector 274 is applied to port 374 of gate 370 to produce a pilot signal output at port 376 for application to air line W for ultimate application to pilot port 380 of pilot valve 382, causing it to go to air "on" condition, permitting lubricant to be applied to mixer 318 and, thru line 68 to tamper tool 88 for a length of time determined by delay element 366. Following that lubrication step, a signal from delay line 380 causes purging of the tool 88 and the line 68 of lubricant, following which timer 232 applies full air pressure to mist collector 270, all other air using elements being shut down. The timing of mist collector timer 232 is controlled by dial adjustable timer 234 and accumulators 236 and 238. The cycle having been completed, i.e., the cleaning, lubricating and collecting operations have been completed, no signal appears at 220 of set-reset element 218 and the system is prepared for its next cycle of operation.

If selector 276 is pressed, the same cycle as that described for the pressing of selector 274 occurs, except that tool 86 is cleaned and lubricated, with the associated components mixer 390, check valves 400, 402, pressure regulator 394, and pilot valves 392, 396 and 398 functioning in the same fashion, in connection with tool 86 as their corresponding components mixer 318, check valves 315, 324, pressure regulator 322 and pilot valves 320, 316 and 382, respectively, operate in connection with tool 88. Similarly, "NOT"-gate 371 feeds the same control signal from its output port 408 to "AND"-gates 370 and 404, which, respectively, control the lubricant valves 398 and 382 in the tool 86 and tool 88 cleaning-lubricating circuits. Similarly, the output signal from port 410 of "NOT"-gate 367 feeds the "AND"-gates 369 and 406 which control air-control valves 320 and 392, respectively, for tools 88 and 86, respectively. Air signals on air-line F from selector 274 are applied to input ports 412 and 414 of "AND"-gates 369 and 370, respectively. Further, such signals are applied to the pilot in valve 316.

Air signals from selector 276 are applied to input ports 416, 418 of "AND"-gates 406, 404, respectively, as well as to the pilot in valve 396.

When the output port 410 of "NOT"-gate is pressurized as a result of no pressure at port 420 and pressure at port 422, a pressure signal is applied to port 424 of "AND"-gate 369 and to port 426 of "AND"-gate 406.

When pressure signals are applied to ports 412, 424 of gate 369 a pressure signal appears at output port 428, thereof, and such pressure is applied to air line V and, thence, to the pilot in valve 320.

When pressure signals appear at both ports 416 and 426 of "AND"-gate 406, and output air signal appear at port 430 thereof and such signal is applied to air line T for application to the pilot in air-control valve 392, thus turning it on.

When port 408 of "NOT"-gate 371 is pressurized, i.e., when the purging step is completed, that pressure signal is transmitted to ports 372 and 436 of "AND"-gates 370 and 404, respectively, and output air signals appear at ports 376, 438, respectively, (assuming selectors 274, 276 are "on") for application to control lines W and U, respectively, and, consequently, to the pilots in pilot valves 382 and 398, turning those valves on and causing lubricant to flow into mixers 318, 390, respectively, for ultimate deliverance to tools 88, 86, respectively.

Thus, sequencing and timing of the cleaning, purging, lubricating and mist collecting steps is realized, automatically.

The timing of the steps, in one embodiment of this invention, is 25 seconds for cleaning and purging, 7.5 seconds for lubricating and lubricant purging and 25 seconds for high speed mist collection.

In connection with the lubricating step, air is applied from the main source 208 thru a pressure regulator 450 to a lubricant tank 452 which has a flow gage 454 shunting it. The output lubricant passes thru shut-off valve 456 to the input ports 458 and 460 of lubricant control valves 398 and 382, respectively.

Elements 470, 472 are part of a venting system for mixers 390, 318. Tank 472 and tube 473 constitute a flow-gate for Diesel fuel. Ball valves 474, 476 permit alternate routing of fuel from tank 312. Valves 478, 480, 482 and 484 are on-off ball valves. Elements 490 are needle valves.

While a particular embodiment of this invention has been shown and described it is apparent to those ordinarily skilled in the art that alterations or modifications may be made therein without departing from the true scope of this invention. It is the purpose of the appended claims to cover all such modifications and alterations.

What is claimed is:

1. Apparatus for maintaining pneumatic tools including:

an input connector for receiving air under pressure;

tool-retaining means for retaining, in a desired location, a tool to be maintained, said retaining means being, at least in part, pneumatically operated;

a source of maintaining-fluid mixing and coupling means coupled to said input connector and to said source of maintaining-fluid for providing said maintaining-fluid, mixed with air under pressure, to the input port of a pneumatic tool to be cleaned;

said mixing and coupling means including automatic timing means for providing for a predetermined period to a tool to be maintained, maintaining-fluid and air;

a sealable cabinet surrounding said tool-retaining means and having an access door sealably carried by said cabinet; and, safety interlock means mechanically carried by said sealable cabinet and positioned for engagement by said access door when said access door is in a closed condition but not when said access door is in an opened condition, said safety interlock means being coupled to said mixing and coupling means to effect control thereof in automatic response to the condition of said access door.

2. Apparatus according to claim 1 in which said sealable cabinet has a pneumatically sealed reviewing window therein.

3. Apparatus according to claim 1 in which said access door is of the shutter type.

* * * * *